US007321743B2

(12) United States Patent
Kimura et al.

(10) Patent No.: US 7,321,743 B2
(45) Date of Patent: Jan. 22, 2008

(54) DEVELOPER RECOVERING MECHANISM AND IMAGE FORMING APPARATUS

(75) Inventors: Masamichi Kimura, Iwatsuki (JP); Kazunori Koshimori, Iwatsuki (JP); Yukimitsu Yoshida, Iwatsuki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 158 days.

(21) Appl. No.: 11/061,597

(22) Filed: Feb. 22, 2005

(65) Prior Publication Data

US 2005/0254860 A1 Nov. 17, 2005

(30) Foreign Application Priority Data

May 14, 2004 (JP) ..... 2004-144718

(51) Int. Cl.
*G03G 15/01* (2006.01)

(52) U.S. Cl. ..... 399/227

(58) Field of Classification Search ..... 399/227, 399/262, 360, 358

See application file for complete search history.

(56) References Cited

U.S. PATENT DOCUMENTS 6,192,211 B1 * 2/2001 Kimura ..... 399/227
6,987,940 B2 1/2006 Tamura
7,035,574 B2 * 4/2006 Deguchi et al. ..... 399/262
2003/0202823 A1 * 10/2003 Tamura ..... 399/227

FOREIGN PATENT DOCUMENTS

CN 1455302 A 11/2003
JP 10-198144 A 7/1998

* cited by examiner

*Primary Examiner*—Susan Lee
(74) *Attorney, Agent, or Firm*—Sughrue Mion, PLLC

(57) ABSTRACT

A developer recovering mechanism used in a developing apparatus having a developer cartridge which houses developer, a developing unit in which the developer cartridge is installed and which can make a latent image of an image carrier visible by the developer, and a rotor at which the developing unit is loaded and which rotates and moves the developing unit successively to a developing region, the developer recovering mechanism having: a housing chamber provided at the developer cartridge, for housing recovered developer; a recovery opening for recovering developer, which is in the developing unit, into the housing chamber; and a shutter which is plate-shaped, one end side of the shutter being rotatably shaft-supported within the housing chamber, the shutter opening and closing the recovery opening in accordance with changes in gravity due to rotation of the rotor.

16 Claims, 15 Drawing Sheets

DEVELOPER RECOVERING MECHANISM AND IMAGE FORMING APPARATUS

CROSS-REFERENCE TO RELATED APPLICATION

This application claims priority under 35 USC 119 from Japanese Patent Application No. 2004-144718, the disclosure of which is incorporated by reference herein.

BACKGROUND OF THE INVENTION

1. Field of the Invention

The present invention relates to a developer recovering mechanism which recovers developer within a developing unit to a developer cartridge installed in the developing unit, and to an image forming apparatus, and, in particular, to a developer recovering mechanism used in a rotary-type developing apparatus which rotates plural developing units and successively moves them to a developing region, and to an image forming apparatus provided with this developer recovering mechanism.

2. Description of the Related Art

Among conventional image forming apparatuses, there is known a type which is provided with a rotary-type developing apparatus in which plural developing units, which house toners of different colors, are disposed along a peripheral direction, and these developing units are rotated by a rotor so as to successively be moved to a developing region which opposes a photosensitive body. Such an image forming apparatus is structured such that, for example, four developing units housing toners of the respective colors of yellow, magenta, cyan, and black are moved successively to the developing region, toner images of the four colors are successively formed on the photosensitive body, and the toner images of the four colors are superposed on one another on a recording medium or an intermediate transfer body such that a color image is formed.

A developer cartridge is removably disposed at each of the developing units. The developer cartridge, for example, replenishes new developer to the interior of the developing unit, and recovers the developer which is within the developing unit.

A recovery opening for recovery of the developer within the developing unit is provided at an end surface of the developer cartridge. One end of a film-shaped member is fixed and supported at this end surface in which the recovery opening is formed. A weight is attached to the other free end of the film-shaped member, and this free end opens and closes the recovery opening.

At the time when the developing units are successively moved by rotation of the rotor, when the recovery opening is positioned beneath a supporting portion of the film-shaped member, the film-shaped member closes the recovery opening. On the other hand, when the recovery opening is positioned above the supporting portion of the film-shaped member, the film-shaped member flexes due to the gravity of the weight, and the recovery opening is opened. The developer within the developing unit is then recovered to the developer cartridge from the recovery opening which has been opened (see, for example, Japanese Patent Application Laid-Open (JP-A) No. 10-198144).

However, in the developer cartridge disclosed in this JP-A No. 10-198144, in order to fix and support the film-shaped member, a plate member is attached by being press-fit and welded to an end surface from above the film-shaped member. There are therefore the problems that the manufacturing processes are complex and the manufacturing costs are high.

Further, the recovery opening is opened and closed by the gravity of the weight which is attached to the film-shaped member. Therefore, there are the problems that, even when the recovery opening is closed, it is easy for the film-shaped member to flex, and it is easy for the developer to flow backwards into the developing unit from a gap between the recovery opening and the film-shaped member.

SUMMARY OF THE INVENTION

The present invention was developed in order to overcome the above-described problems, and an object of the present invention is to provide a developer recovering mechanism and an image forming apparatus in which it is possible to prevent the manufacturing processes from becoming complex, and the manufacturing costs can be reduced. Moreover, an object of the present invention is to prevent developer from flowing backward from a recovery opening of a developer cartridge to the interior of a developing unit.

In order to overcome the above-described problems, a first aspect of the present invention is a developer recovering mechanism used in a developing apparatus having a developer cartridge which houses developer, a developing unit in which the developer cartridge is installed and which can make a latent image of an image carrier visible by the developer, and a rotor at which the developing unit is loaded and which rotates and moves the developing unit successively to a developing region, the developer recovering mechanism comprising: a housing chamber provided at the developer cartridge, for housing recovered developer; a recovery opening for recovering developer, which is in the developing unit, into the housing chamber; and a shutter which is plate-shaped, one end side of the shutter being rotatably shaft-supported within the housing chamber, the shutter opening and closing the recovery opening in accordance with changes in gravity due to rotation of the rotor.

In accordance with the developer recovering mechanism of the present aspect, the developing unit, in which the developer cartridge is installed, successively moves to the developer region due to the rotation of the rotor. The recovery opening, which recovers the developer, is provided at the housing chamber which is formed in the developer cartridge. One end side of the plate-shaped shutter, which opens and closes the recovery opening, is rotatably shaft-supported within the housing chamber. When the developing unit moves due to the rotation of the rotor, the shutter rotates in accordance with the change in gravity caused by the movement of the developing unit, such that the recovery opening is opened and closed. When the shutter is open due to the change in gravity at the time of movement, the developer within the developing unit is recovered from the recovery opening to the interior of the housing chamber. Further, when the shutter is closed due to the change in gravity at the time of movement, the recovery of the developer from the developing unit is stopped.

In this developer recovering mechanism, because one end side of the plate-shaped shutter is rotatably shaft-supported, the structure for opening and closing the shutter can be simplified, and there are needed only a few parts therefor. Therefore, the manufacturing process can be prevented from becoming complex, and an increase in cost can be prevented.

In a second aspect of the present invention, the developer recovering mechanism based on the above-described first aspect further has a regulating plate which stands erect from a shaft portion side of the shutter, and which regulates back flow of the developer within the housing chamber to the recovery opening.

In accordance with the developer recovering mechanism of the present aspect, the regulating plate stands erect from the shaft-supporting portion side of the shutter. When the shutter is opened due to the rotation of the rotor, the developer within the housing chamber is regulated by the regulating plate, and does not move toward the recovery opening. Therefore, the developer within the housing chamber can be prevented from flowing backward from the recovery opening into the developing unit. Further, the regulating plate stands erect from the shaft-supporting portion side of the shutter and does not obstruct opening of the shutter.

In a third aspect of the present invention, the regulating plate of the developer recovering mechanism based on the above-described second aspect is provided so as to face the recovery opening, and regulates an angle of rotation of the shutter at a time when the shutter is open, the regulating plate being set to a height such that the developer within the housing chamber does not leak out to the recovery opening.

In accordance with the developer recovering mechanism of the present aspect, the regulating plate is provided so as to face the recovery opening. The angle of rotation, at the time when the shutter abuts the regulating plate and is open, is regulated by the regulating plate. The regulating plate is set to a height such that the developer within the housing chamber does not leak out to the recovery opening. When the shutter is open, the developer within the housing chamber is prevented from flowing backward from the recovery opening to the interior of the developing unit.

In a fourth aspect of the present invention, the recovery opening based on any one of the above-described first through third aspects and a shaft-supporting portion which supports a shaft portion of the shutter, are molded integrally with a tubular cap which is attached to an opening (end) of the housing chamber.

In accordance with the developer recovering mechanism of the present aspect, the recovery opening and the shaft-supporting portion of the shutter are formed integrally with the tubular cap, and the tubular cap is attached to the opening of the housing chamber. Therefore, the shape of the housing chamber of the developer cartridge can be made simple. That is, the manufacturing can be made simple, the assembly processes can be simplified, and the manufacturing cost can be reduced even more.

In a fifth aspect of the present invention, the shutter of the developer recovering mechanism based on any one of the above-described first through fourth aspects is formed by a plate body which blocks the recovery opening, and a shaft which extends from a corner portion of the plate body, and the shaft-supporting portion, which is provided at the cap in order to support the shaft, is formed by a pair of groove portions which support end portions of the shaft, and a presser plate which is provided between the pair of groove portions and prevents the shaft from falling out from the groove portions.

In accordance with the developer recovering mechanism of the present aspect, the shutter is structured by a plate body which blocks the recovery opening. The end portions of the shaft, which extends from a corner portion of the plate body, are supported by the pair of groove portions. The plate body opens and closes the recovery opening due to the rotation of the shaft. The presser plate is provided between the pair of groove portions, such that the shaft which rotates can be prevented from falling-out from the groove portions. In this structure, the shutter can be assembled-in by a one-touch operation merely by pushing the shaft into the groove portions.

In a sixth aspect of the present invention, an image forming apparatus is provided with the developer recovering mechanism based on any one of the above-described first through fifth aspects.

In accordance with the image forming apparatus of the present aspect, because the developer recovering mechanism based on any one of the first through fifth aspects is provided, the shutter of the recovery opening is opened and closed in accordance with changes in gravity due to rotation of the rotor, and the developer within the developing unit is recovered to the developer cartridge.

Therefore, the structure for opening and closing the shutter is simple, the manufacturing processes can be simplified, and the manufacturing cost can be reduced. Further, by providing the regulating plate, the developer within the developer cartridge can be reliably prevented from flowing backward into the developing unit.

Because the developer recovering mechanism and the image forming apparatus relating to the present invention are structured as described above, the number of required parts thereof is small, the manufacturing processes thereof can be simplified, and the manufacturing cost thereof can be reduced. Moreover, by providing the regulating plate, the developer housed in the developer cartridge can be prevented from flowing backward into the developing unit.

DETAILED DESCRIPTION OF THE INVENTION

Hereinafter, a first embodiment of an image forming apparatus relating to the present invention will be described on the basis of the drawings.

First, an overview of the structure of the image forming apparatus will be described, and then the main portions of the present invention will be explained.

Figure 1:
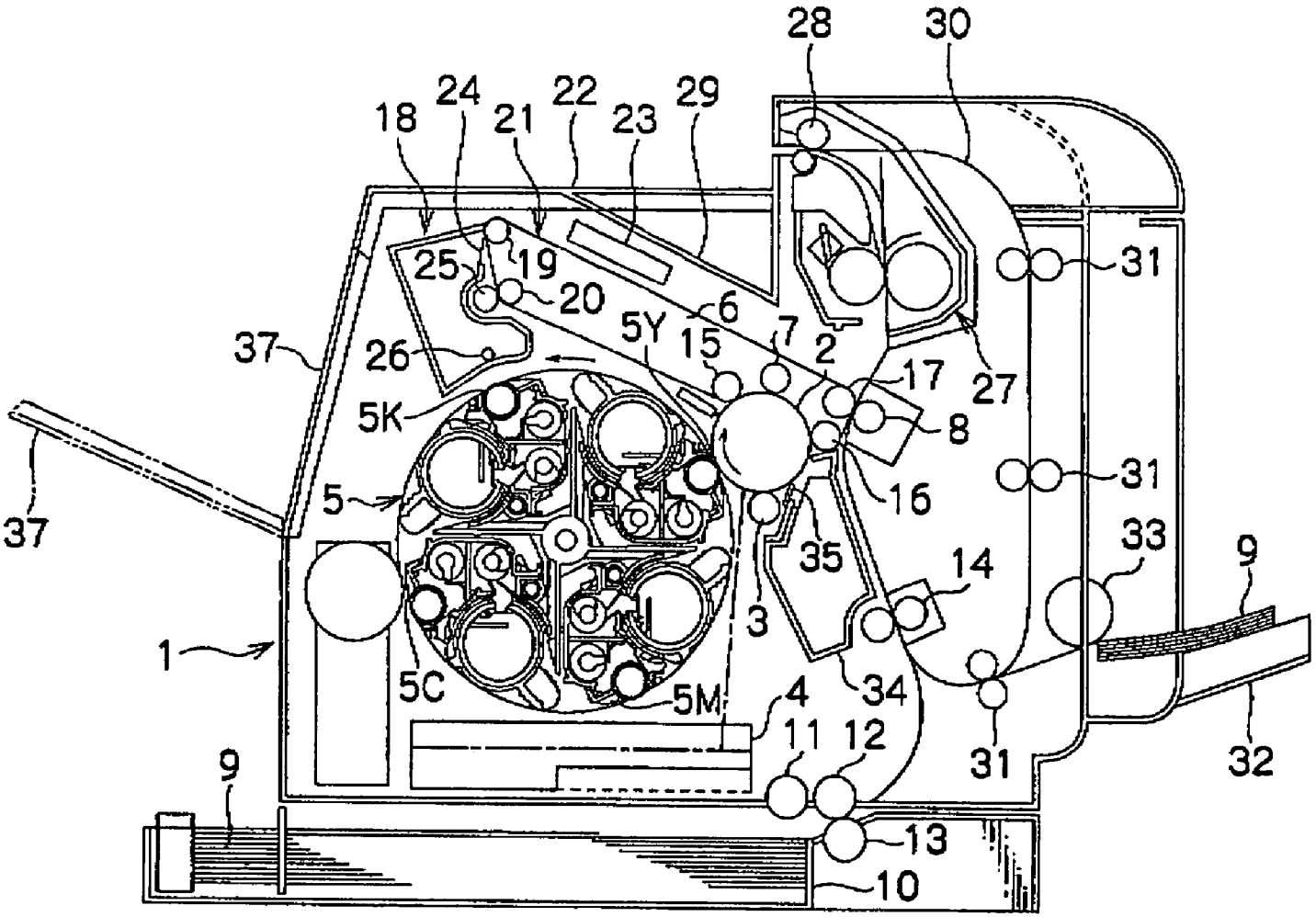
FIG. 1 is a schematic structural diagram showing a full-color printer relating to a first embodiment of the present invention.

FIG. 1 is a schematic structural diagram showing a full-color printer 1 which is an image forming apparatus of the present embodiment.

A photosensitive drum 2 serving as an image carrier is rotatably disposed within the full-color printer 1 at a portion slightly upward and to the right of the center thereof. A photosensitive layer covers the surface of the photosensitive drum 2, and the photosensitive drum 2 is driven to rotate in the direction of the arrow by an unillustrated driving means.

The surface of the photosensitive drum 2 is charged to a predetermined potential by a charging roller 3 which is disposed substantially directly beneath the photosensitive drum 2. Thereafter, laser beams (LB) are exposed by a ROS (Raster Output Scanner) 4, which serves as an exposing means and which is disposed at a position directly beneath but away from the photosensitive drum 2, such that electrostatic latent images corresponding to image information are formed.

The electrostatic latent images formed on the photosensitive drum 2 are developing by a rotary-type developing apparatus 5, in which developing units 5Y, 5M, 5C, 5K of the respective colors of yellow (Y), magenta (M), cyan (C), black (K) are disposed along the peripheral direction. Toner images of predetermined colors are thereby formed.

At this time, the charging, exposing and developing processes are repeated a predetermined number of times on the surface of the photosensitive drum 2, in accordance with the colors to the images to be formed. At the rotary-type developing apparatus 5, the developing units 5Y, 5M, 5C, 5K of the corresponding colors move to a developing region which faces the photosensitive drum 2.

For example, in the case of forming a full-color image, the charging, exposing and developing processes are repeated on the surface of the photosensitive drum 2 four times in correspondence with the respective colors of yellow (Y), magenta (M), cyan (C), black (K). Toner images corresponding to the respective colors of yellow (Y), magenta (M), cyan (C), black (K) are successively formed on the surface of the photosensitive drum 2.

At a primary transfer position where an intermediate transfer belt 6 is wound on the outer periphery of the photosensitive drum 2, the toner images of the respective colors of yellow (Y), magenta (M), cyan (C), black (K), which are successively formed on the photosensitive drum 2, are primarily transferred onto the intermediate transfer belt 6 by a primary transfer roller 7 in a state of being superposed together.

The toner images of yellow (Y), magenta (M), cyan (C), black (K), which have been transferred onto the intermediate transfer belt 6 so as to be superposed one on the other, are secondarily transferred all at once by a secondary transfer roller 8 onto a recording sheet 9 which is supplied at a predetermined timing. The recording sheets 9 are sent out by a pick-up roller 11 from a sheet feeding cassette 10 which is disposed at the lower portion of the full-color printer 1, and are supplied in a state of being separated one-by-one by a feed roller 12 and a retard roller 13. The recording sheet 9 is conveyed by a resist roller 14 to the secondary transfer position of the intermediate transfer belt 6 in a state of being synchronized with the toner image which has been transferred onto the intermediate transfer belt 6.

The intermediate transfer belt 6 is, at a predetermined tension, tensely trained about a wrap-in roller 15 which is disposed at the upstream side in the rotating direction of the photosensitive drum 2 and which specifies the wrapping position of the intermediate transfer belt 6, the aforementioned primary transfer roller 7, a wrap-out roller 16 specifying the wrapping position of the intermediate transfer belt 6 at the downstream side of the wrapping position, a back-up roller 17 abutting the secondary transfer roller 8 via the intermediate transfer belt 6, and a first cleaning back-up roller 19 and a second cleaning back-up roller 20 opposing a cleaning apparatus 18 of the intermediate transfer belt 6. The intermediate transfer belt 6 moves following the rotation of the photosensitive drum 2.

The intermediate transfer belt 6, together with the photosensitive drum 2 and the charging roller 3 and the like, integrally structure an image forming unit 21. The entire image forming unit 21 can be freely installed in and removed from the full-color printer 1 by opening an upper cover 22 of the full-color printer 1. Further, a position sensor 23, which is formed by a reflection-type photosensor and detects patches of toner formed on the intermediate transfer belt 6, is disposed above the intermediate transfer belt 6.

The cleaning apparatus 18 of the intermediate transfer belt 6 has a scraper 24, which is disposed so as to abut the surface of the intermediate transfer belt 6 which is tensely trained about the first cleaning back-up roller 19, and a cleaning brush 25, which is disposed so as to press-contact the surface of the intermediate transfer belt 6 which is tensely trained about the second cleaning back-up roller 20. The residual toner and paper dust removed by the scraper 24 and the cleaning brush 25 are recovered at the interior of the cleaning apparatus 18.

The cleaning apparatus 18 is disposed so as to be swingable around a swing shaft 26 in the counterclockwise direction in the drawing. Up until the time that the secondary transfer of the toner image of the final color is completed, the cleaning apparatus 18 is withdrawn to a position at which it is separated from the surface of the intermediate transfer belt 6. When the secondary transfer of the toner image of the final color is completed, the cleaning apparatus 18 abuts the surface of the intermediate transfer belt 6.

The recording sheet 9, to which the toner image has been transferred from the intermediate transfer belt 6, is conveyed to a fixing unit 27. The toner image is fixed on the recording sheet 9 by heat and pressure by the fixing unit 27. In the case of a one-sided print, the recording sheet 9 is discharged as is by a discharge roller 28 onto a discharge tray 29 provided at the top portion of the full-color printer 1.

On the other hand, in the case of a duplex (two-sided) print, the recording sheet 9, on which the toner image has been fixed by the fixing unit 27, is not discharged out as is onto the discharge tray 29 by the discharge roller 28. In a state in which the trailing end portion of the recording sheet 9 is nipped by the discharge roller 29, the discharge roller 28 is rotated reversely and the conveying path of the recording sheet 9 is switched to a sheet conveying path 30 for duplex printing. Then, in a state in which the obverse and reverse of the recording sheet 9 are reversed, the recording sheet 9 is again conveyed to the secondary transfer position of the intermediate transfer belt 6 by conveying rollers 31 disposed at the sheet conveying path 30 for duplex printing, and an image is formed on the reverse of the recording sheet 9.

A manual feed tray 32 may be attached, as an option, to the side surface of the full-color printer 1 so as to be able to be opened and closed freely.

The recording sheet 9 of an arbitrary size and type which is placed on the manual feed tray 32, is supplied by a sheet feeding roller 33, and is conveyed to the secondary transfer position of the intermediate transfer belt 6 via the conveying rollers 31 and the resist roller 14. An image can thereby be formed even on the recording sheet 9 of an arbitrary size and type.

Note that, each time the photosensitive drum 2 rotates one time, residual toner and the like are removed from the surface of the photosensitive drum 2, after the process of transferring the toner image has been completed, by a cleaning blade 35 of a cleaning apparatus 34 which is disposed diagonally downward of the photosensitive drum 2, so as to prepare for the next image forming step.

Figure 2:
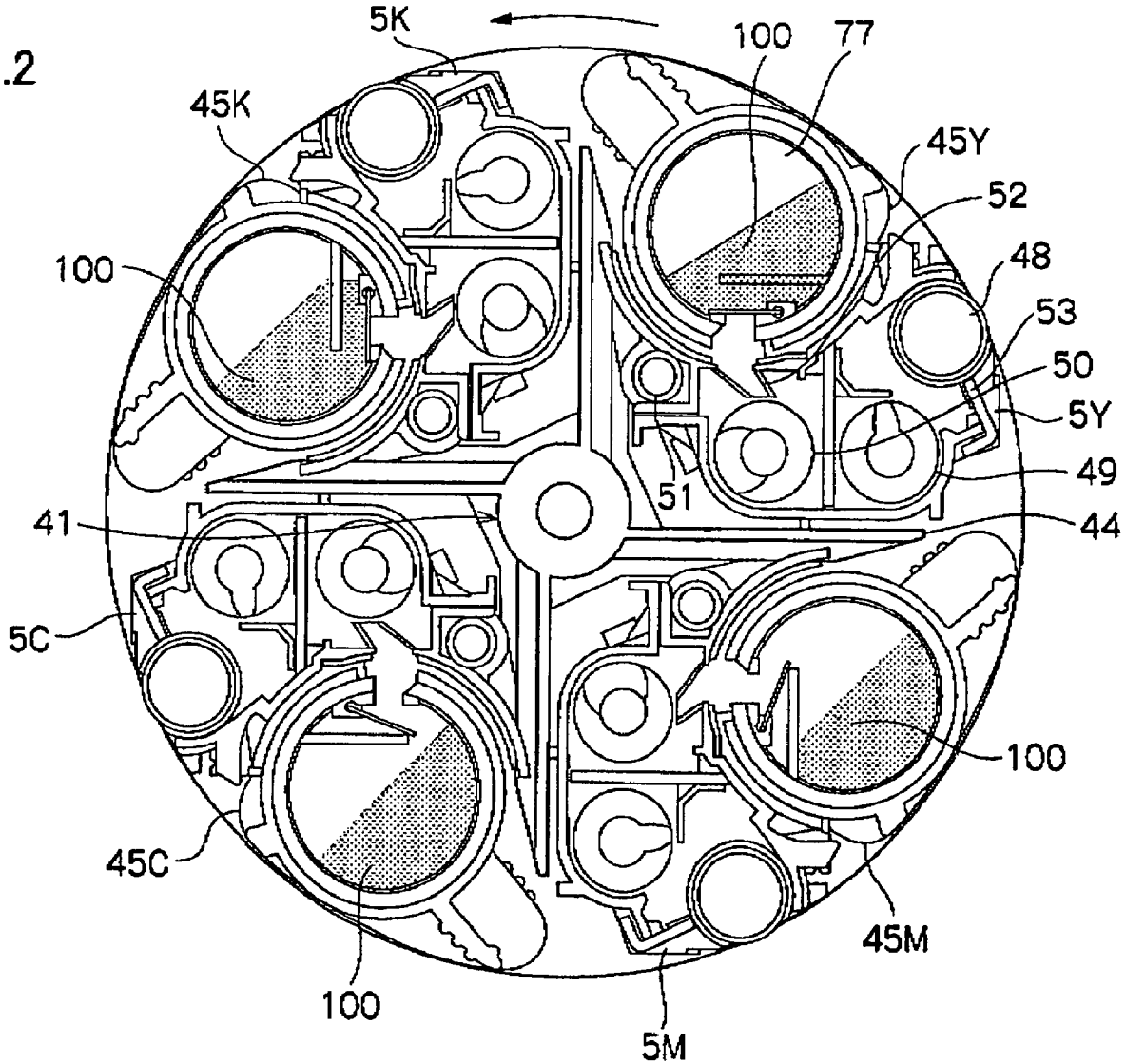
FIG. 2 is a structural diagram showing a rotary-type developing apparatus of the full-color printer relating to the first embodiment of the present invention.
Figure 3:
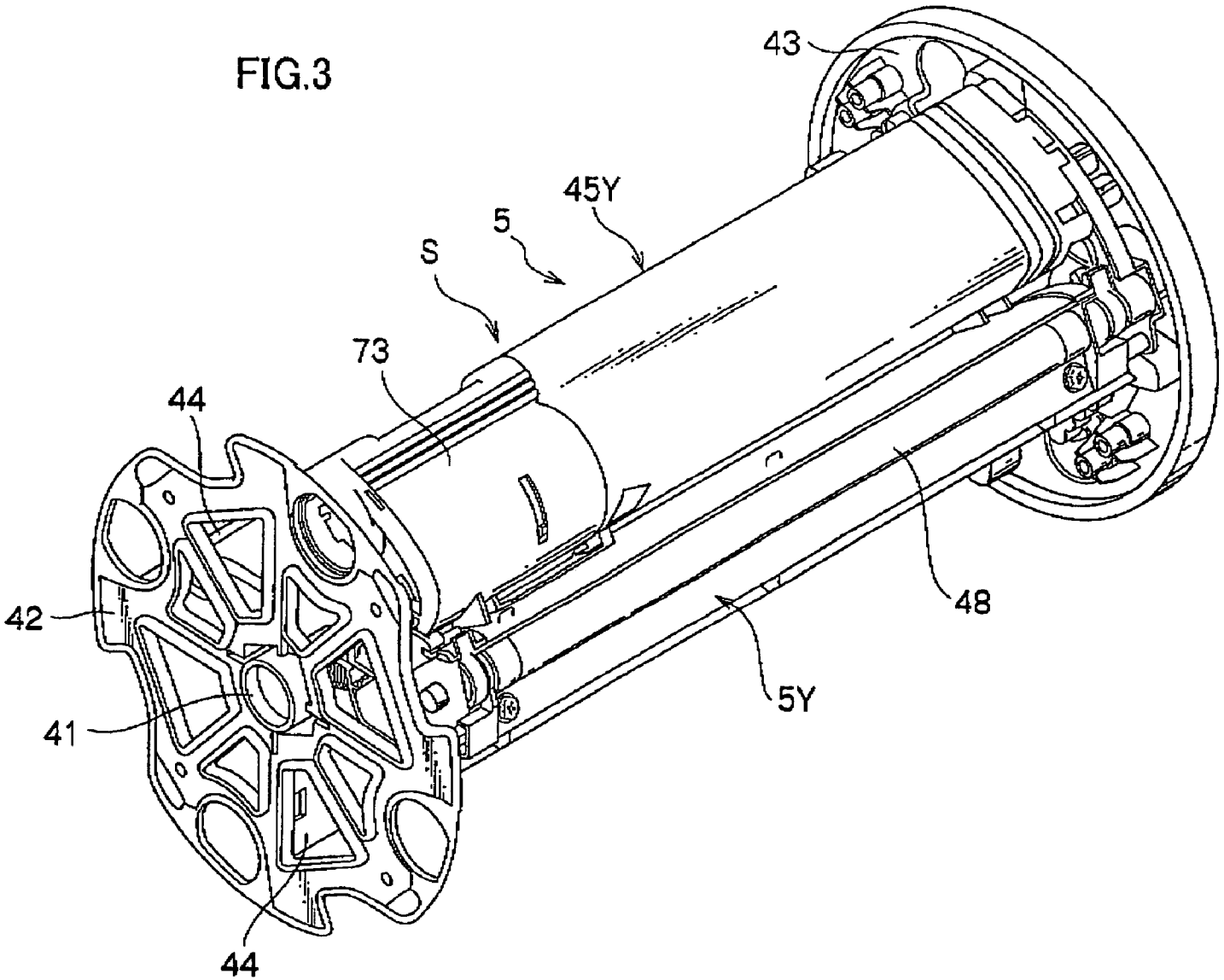
FIG. 3 is a perspective view showing the rotary-type developing apparatus in which is loaded a developer cartridge of the full-color printer relating to the first embodiment of the present invention.

FIG. 2 is a sectional view showing the rotary-type developing apparatus 5 which is applied to the full-color printer 1 relating to the present embodiment. FIG. 3 is an exterior perspective view showing the rotary-type developing apparatus 5. Note that, for convenience, a state in which the one developing unit 5Y and one developer cartridge 45Y are loaded at a rotating shaft member 41 is shown in FIG. 3.

As shown in FIGS. 2 and 3, the rotary-type developing apparatus 5 has the rotating shaft member 41 which is shaped as a cylindrical tube and which is disposed at the central portion of the rotary-type developing apparatus 5 along the longitudinal direction, flange members 42, 43 disposed at the longitudinal direction both end portions of the rotating shaft member 41, and partitioning members 44 partitioning a cylindrical-tube shaped space S formed by the flange members 42, 43 into four sections at each 90°.

As shown in FIG. 2, the rotary-type developing apparatus 5 is mounted to the full-color printer 1 so as to be able to rotate in the direction of the arrow (counterclockwise) around the rotating shaft member 41. The four developing units 5Y, 5M, 5C, 5K of yellow (Y), magenta (M), cyan (C), black (K) are installed along the peripheral direction in the rotary-type developing apparatus 5. Four developer cartridges 45Y, 45M, 45C, 45K of yellow (Y), magenta (M), cyan (C), black (K) are installed along the peripheral direction in the rotary-type developing apparatus 5 in correspondence with the developing units 5Y, 5M, 5C, 5K.

Because the developing units 5Y, 5M, 5C, 5K are all structured similarly, the yellow (Y) developing unit 5Y will be described as an example here.

As shown in FIG. 2, a developing roller 48 which is disposed such that a portion thereof is exposed, and two spiral augers 49, 50 which are positioned at the diagonally downward back surface side of the developing roller 48 and extend parallel to the developing roller 48, are provided within the developing unit 5Y. A spiral agitator 51, which conveys the developer replenished from a supply opening 61 to be described later (see FIG. 6) while stirring the developer, is disposed at the back surface side of the spiral auger 50.

The spiral auger 50 conveys the developer, which is conveyed by the agitator 51 and housed within the developing unit 5Y, while stirring the developer in one direction. The spiral auger 49 conveys the developer while stirring the developer in the direction opposite to the conveying direction of the spiral auger 50, and supplies the developer uniformly to the developing roller 48. The layer thickness of the developer supplied to the surface of the developing roller 48 is regulated by a layer thickness regulating member 53, and as the developing roller 48 rotates, the developer is conveyed to the developing region which faces the photosensitive drum 2.

Note that a two-component developer formed from a toner and a carrier is used as the developer in the present embodiment. However, it suffices for the developer to contain at least toner, and a single-component developer formed only from toner may, of course, be used.

Figure 4:
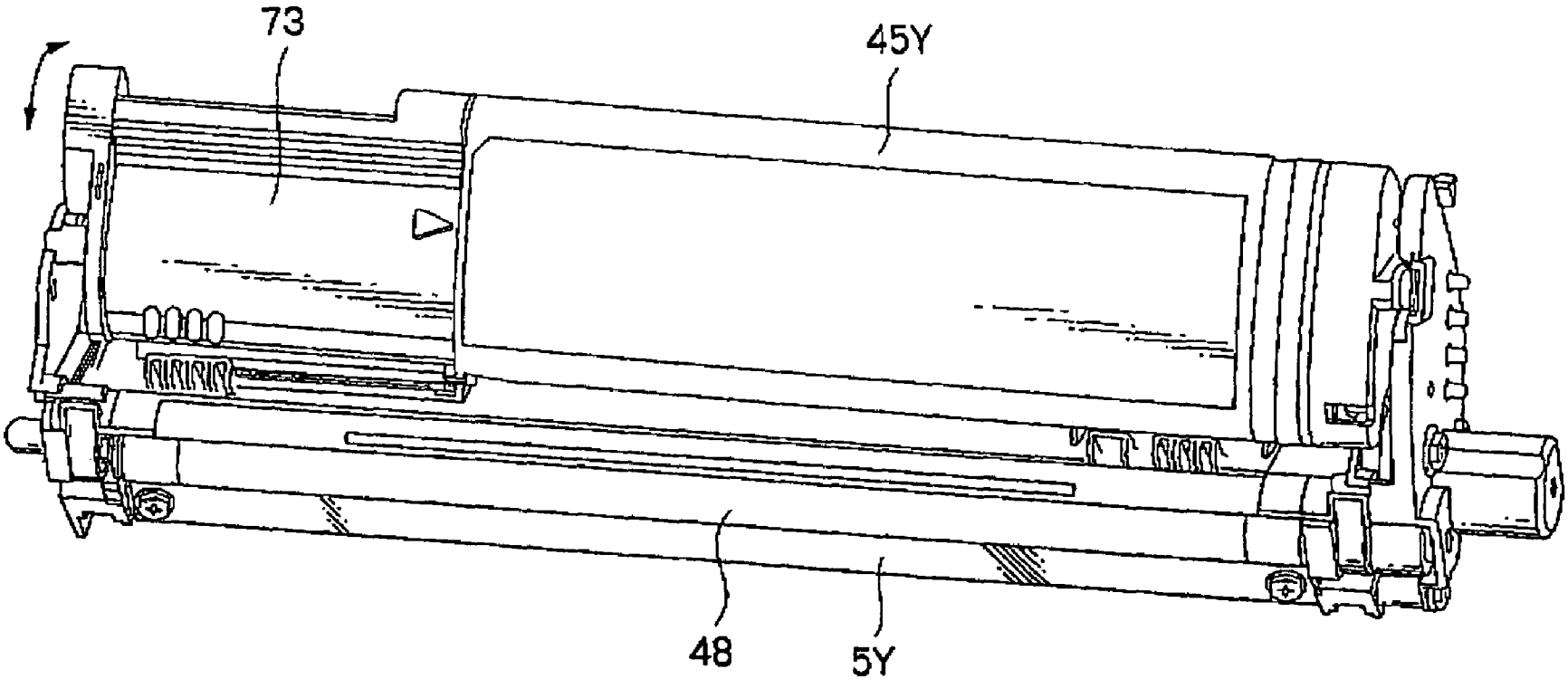
FIG. 4 is a perspective view showing a developing unit in which is installed the developer cartridge of the full-color printer relating to the first embodiment of the present invention.
Figure 5:
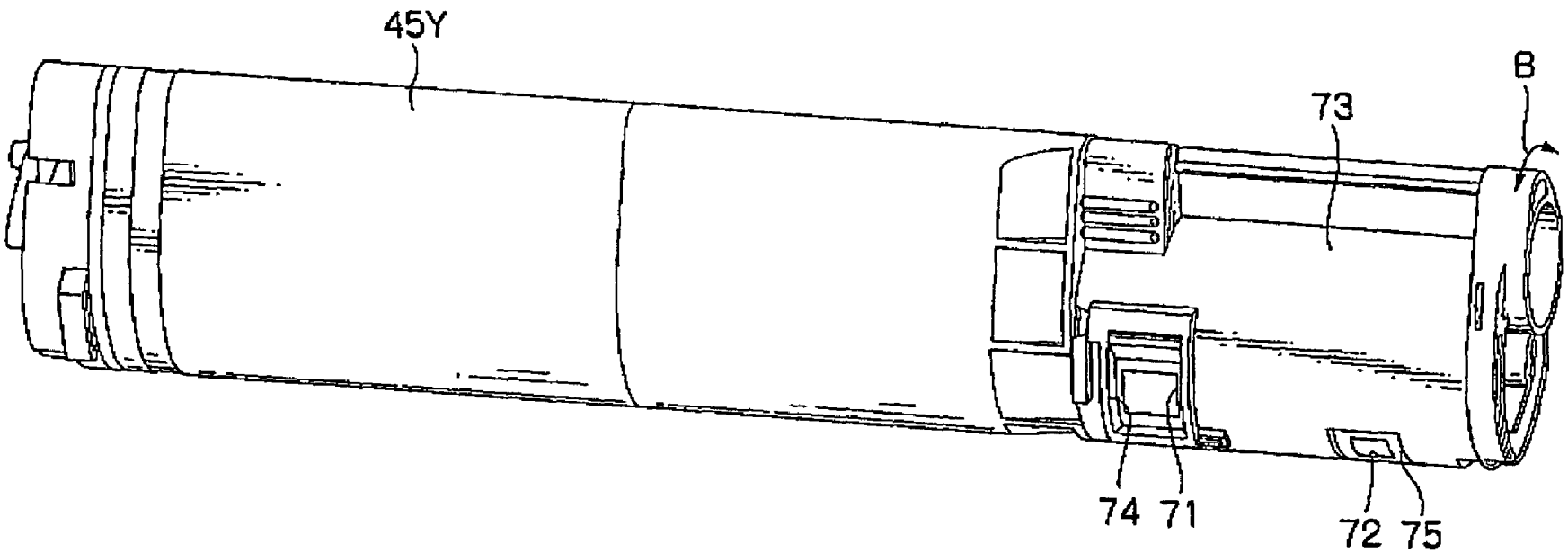
FIG. 5 is a perspective view showing the developer cartridge of the full-color printer relating to the first embodiment of the present invention.
Figure 6:
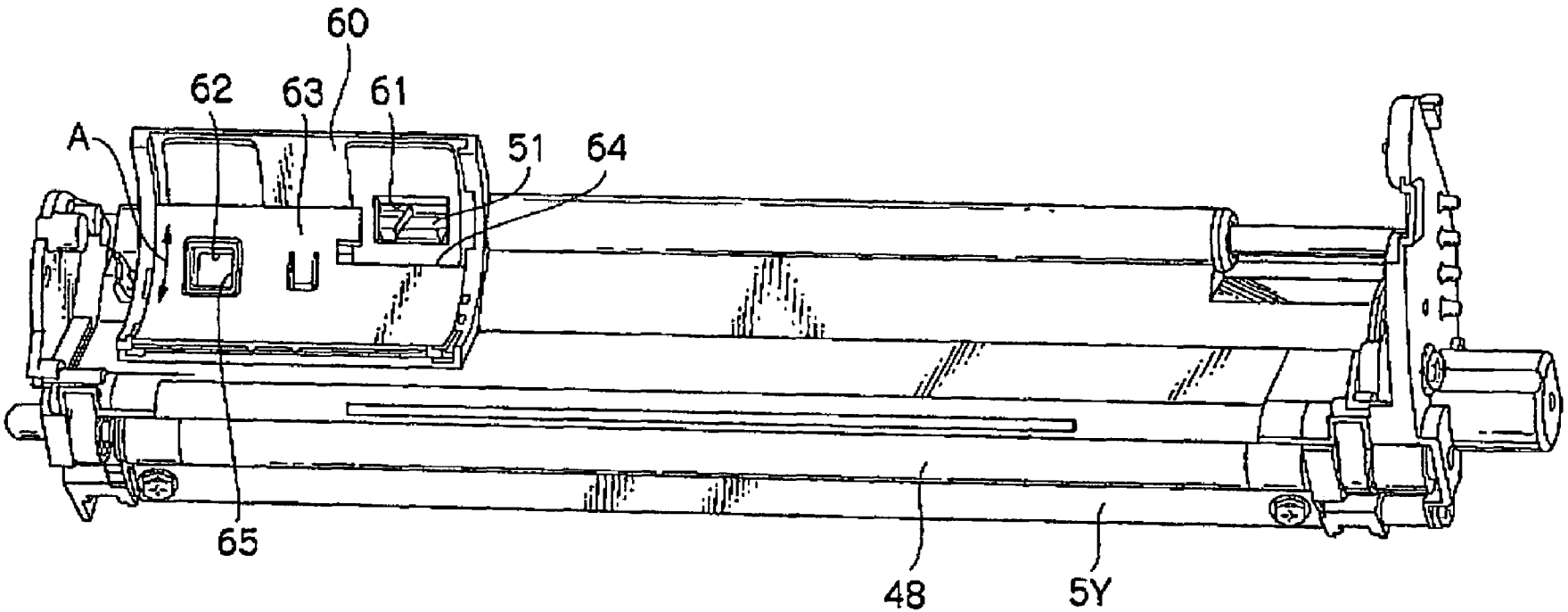
FIG. 6 is a perspective view showing the developing unit of the full-color printer relating to the first embodiment of the present invention.

As shown in FIGS. 4, 5 and 6, the developer cartridge 45Y, in which the yellow (Y) developer is housed, is removably provided at the yellow (Y) developing unit 5Y. By opening a cover 37 which is mounted to the side portion of the full-color printer 1, the developer cartridge 45Y can be removed from the developing unit 5Y, and the developer cartridge 45Y can be replaced (see FIG. 1).

As shown in FIG. 6, the supply opening 61 and a discharge opening 62 are provided at a mounting portion 60 which is arc-shaped and is formed at the upper portion of the developing unit 5Y. New developer is supplied from the developer cartridge 45Y through the supply opening 61. Used developer 100 is recovered in the developer cartridge 45Y through the discharge opening 62.

An arc-shaped shutter member 63 is supported at the mounting portion 60 so as to be slidable in the directions of arrow A, at the top surface of the supply opening 61 and the discharge opening 62. A cut-out 64 and an opening 65 for discharge are formed in the shutter member 63 at positions corresponding to the supply opening 61 and the discharge opening 62. By sliding the shutter member 63 in the directions of arrow A, the supply opening 61 corresponding to the cut-out 64 is opened and closed, and the discharge opening 62 corresponding to the opening 65 for discharge is opened and closed.

The aforementioned agitator 51 is disposed at the inner portion of the supply opening 61, such that the replenished developer is conveyed in a given direction. Further, as shown in FIG. 2, a nozzle 52 is provided at the inner portion of the discharge opening 62 of the developing unit 5Y. The nozzle 52 leads, to the discharge opening 62, the used developer 100 which is conveyed by the spiral auger 50.

Figure 7:
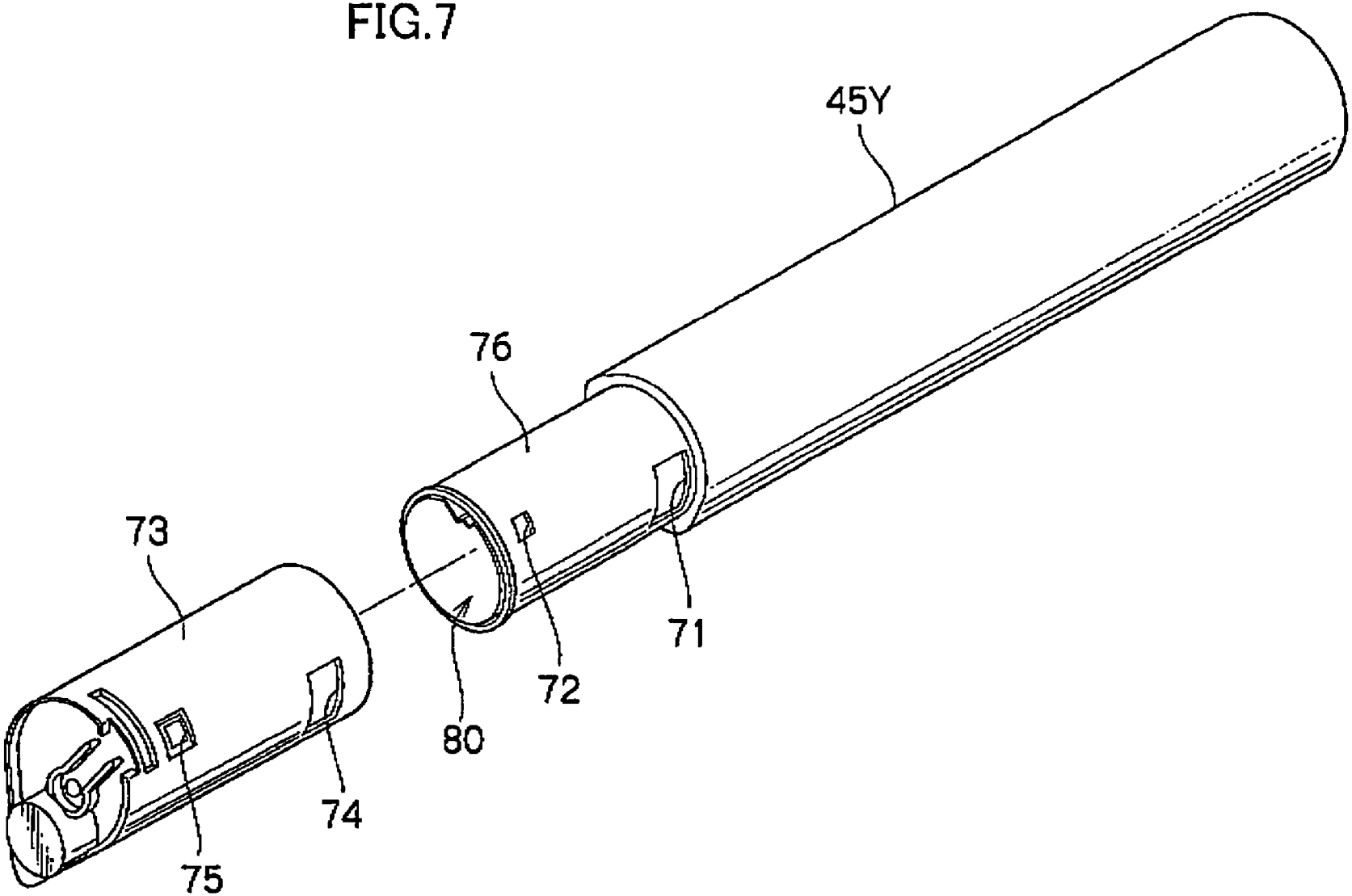
FIG. 7 is a perspective view with a cover member of the developer cartridge shown in FIG. 5 removed.

As shown in FIGS. 5 and 7, the side of the developer cartridge 45Y is a cylindrical tubular body 76, and a cover member 73 is attached to the peripheral surface of the cylindrical tubular body 76. A replenishing opening 71 which supplies new developer to the developing unit 5Y, and a recovery opening 72 through which the used developer 100 is recovered from the developing unit 5Y, are formed in the cylindrical tubular body 76.

An opening 74 for replenishing and an opening 75 for recovery are formed in the cover member 73 at positions facing the replenishing opening 71 and the recovery opening 72. By rotating the cover member 73 in the directions of arrow B, the replenishing opening 71 corresponding to the opening 74 for replenishing is opened and closed, and the recovery opening 72 corresponding to the opening 75 for recovery is opened and closed.

Figure 8:
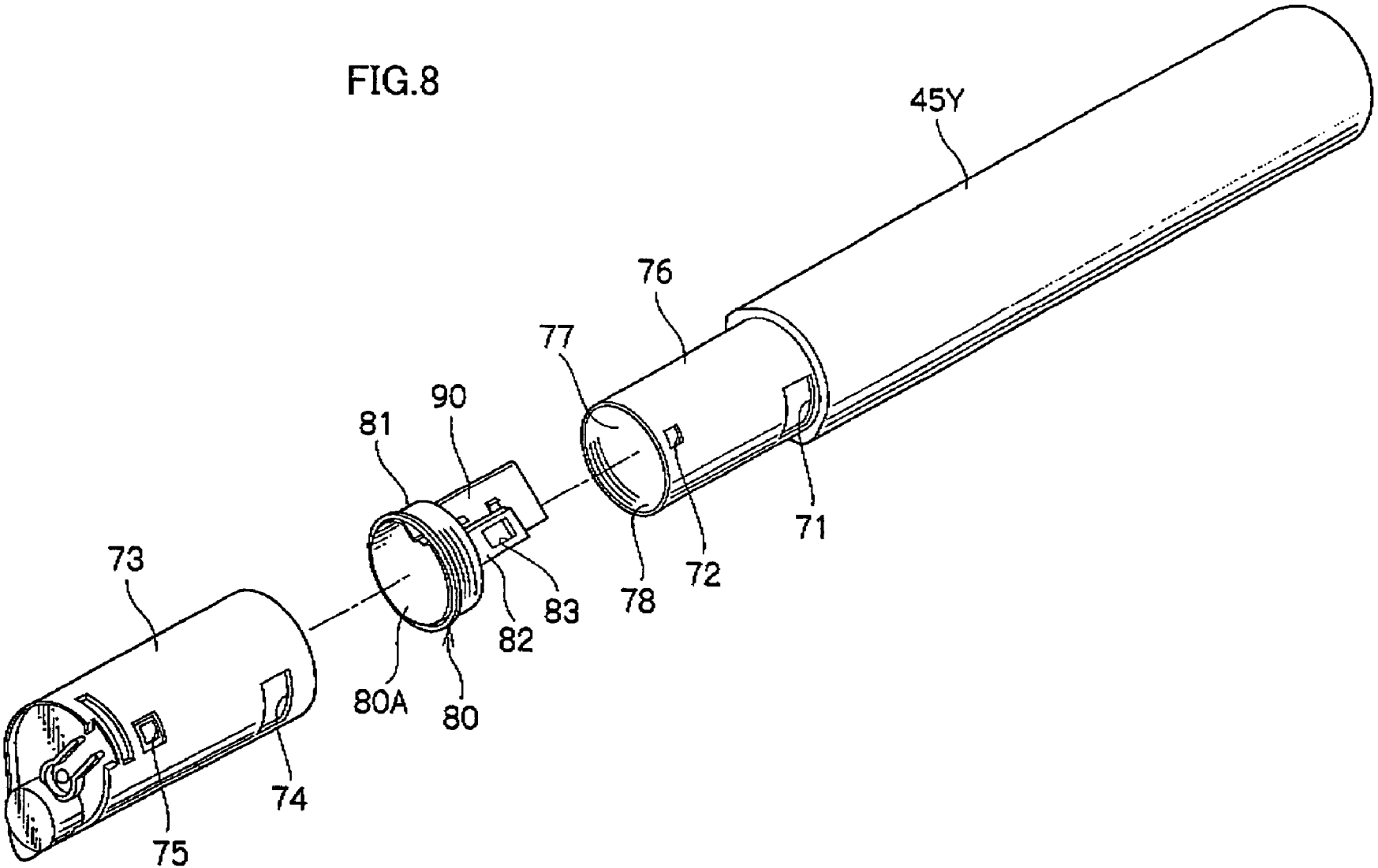
FIG. 8 is an exploded perspective view showing the developer cartridge shown in FIG. 5.

As shown in FIGS. 2 and 8, a housing chamber 77, which communicates with the recovery opening 72 and houses the used developer 100 which has been recovered, is provided within the cylindrical tubular body 76. Further, a developer storing chamber (not illustrated) which stores new developer is provided at a position which communicates with the replenishing opening 71. A partitioning plate (not illustrated) is provided between the developer storing chamber and the housing chamber 77 so that the developers do not mix together.

As shown in FIG. 4, when the developer cartridge 45Y is installed in the developing unit 5Y and the cover member 73 is rotated in the direction of the arrow, the shutter member 63 opens as a result of the rotation of the cover member 73, the supply opening 61 and the replenishing opening 71 are communicated through, and the discharge opening 62 and the recovery opening 72 are communicated through.

Figure 9A:
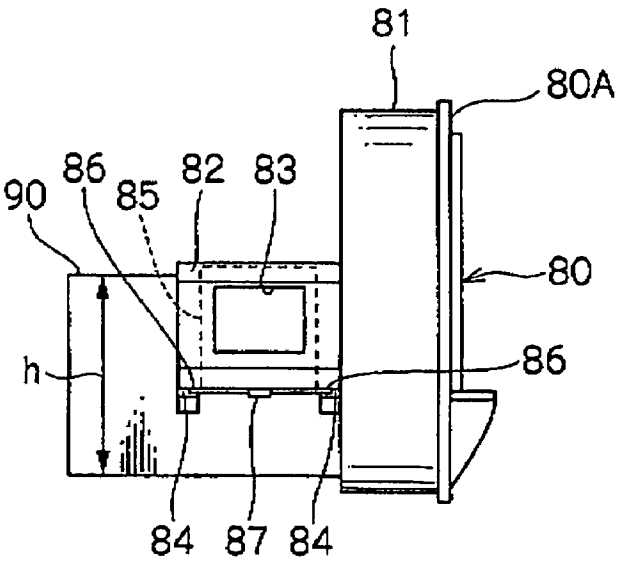
FIGS. 9A, 9B, and 9C are a plan view, a front view, and a side view, respectively, showing a cap of the developer cartridge shown in FIG. 5.
Figure 9C:
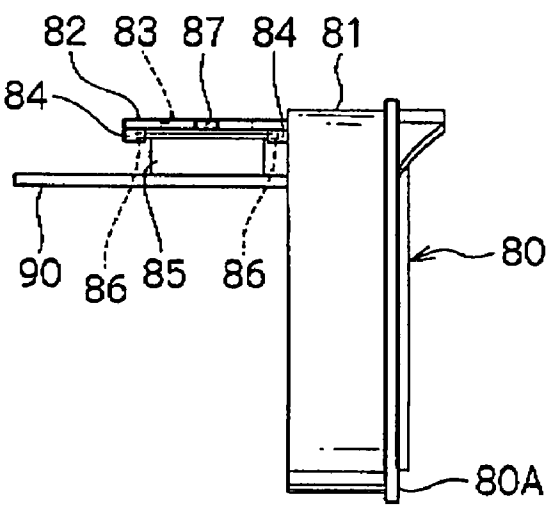
Figure 9B:
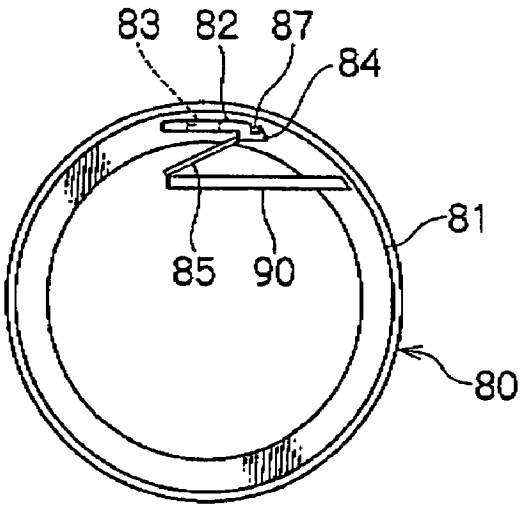

As shown in FIG. 8, an opening 78 is formed at the side portion of the housing chamber 77 of the cylindrical tubular body 76. A tube-shaped cap 80 can be attached to and removed from the opening 78. FIGS. 9A through 9C are respectively a plan view, a front view, and a side view showing the cap 80. A flange 81 is formed at the cap 80 in the direction orthogonal to a cap surface 80A. The cap 80 is attached to the cylindrical tubular body 76 due to the flange 81 being fit-in the opening 78.

A plate piece 82 projects at the inner side of the flange 81. An opening portion 83 is formed in the plate piece 82 at a position corresponding to the recovery opening 72. A pair of groove portions 84 are formed to extend in one side portion of the plate piece 82 (the side portion in the direction orthogonal to the cap surface 80A).

A plate-shaped shutter 85 is provided at a position which closes the opening portion 83. A shaft 86, which extends from corner portions of the shutter 85, is rotatably supported in the groove portions 84. A presser piece 87, which prevents the shaft 86 from coming out from the groove portions 84, extends between the pair of groove portions 84 provided at the plate piece 82.

When the developing unit 5Y and the developer cartridge 45Y move due to the rotation of the rotating shaft member 41 (see FIG. 2), the shutter 85 rotates around the shaft 86 due to the change in gravity, so as to open and close the opening portion 83 (i.e., the recovery opening 72 which corresponds to the opening portion 83) (see FIG. 2).

As shown in FIG. 9B, a regulating plate 90 projects from the flange 81 so as to extend from the shaft 86 side end portion of the shutter 85. When the shutter 85 is open, the shutter 85 hits the regulating plate 90 such that the rotational angle of the shutter 85 is regulated. Further, the regulating plate 90 is set to a height h such that, when the shutter 85 is open, the used developer 100 within the housing chamber 77 does not flow backward to the recovery opening 72.

The plate piece 82 in which the opening portion 83 is formed, the groove portions 84, the presser piece 87, and the regulating plate 90 are molded integrally with the flange 81 of the cap 80. The shutter 85 can be assembled-in by a one-touch operation merely by pushing the shaft 86 of the shutter 85 into the groove portions 84. As shown in FIGS. 7 and 8, the cap 80 is attached to the opening 78 of the cylindrical tubular body 76 such that the opening portion 83 corresponds to the recovery opening 72.

Next, operation of the developer recovering mechanism relating to the present invention, which is the operation of the full-color printer 1 of the present embodiment, will be described.

In the full-color printer 1 of the present embodiment, because the developing units 5Y, 5M, 5C, 5K are all structured similarly, the yellow (Y) developing unit 5Y will be described here as an example.

Figure 10A:
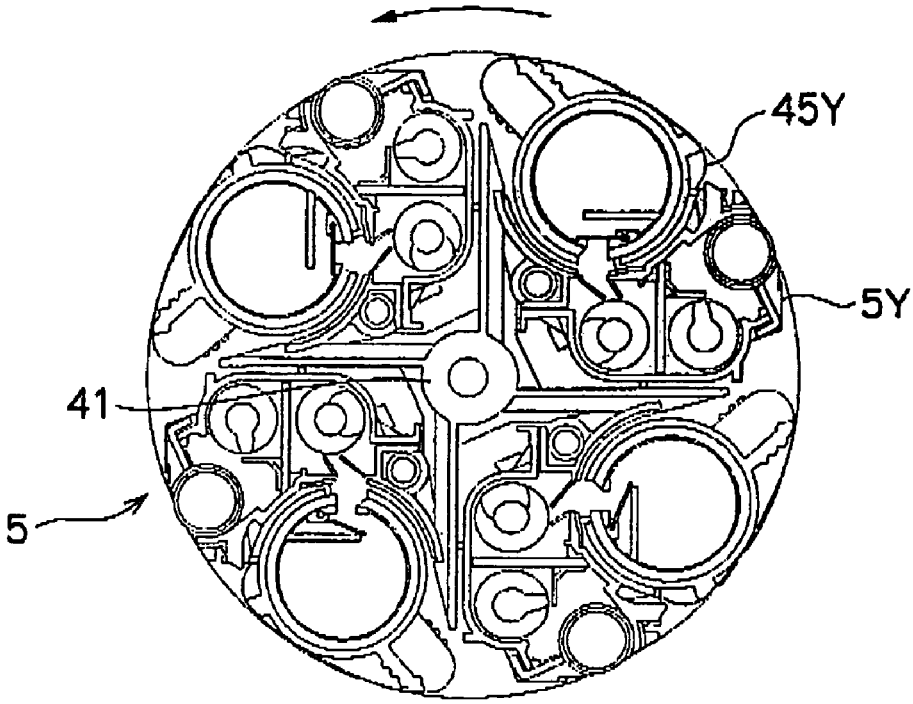
FIGS. 10A and 10D are drawings for explaining a developer recovering mechanism of the full-color printer relating to the first embodiment of the present invention.

As shown in FIG. 10A, when the developing unit 5Y is positioned at the developing region of the full-color printer 1, the latent image on the photosensitive drum 2 is developed by the developing unit 5Y (see FIG. 1). At this time, the developing unit 5Y is positioned lower than the developer cartridge 45Y.

Figure 10B:
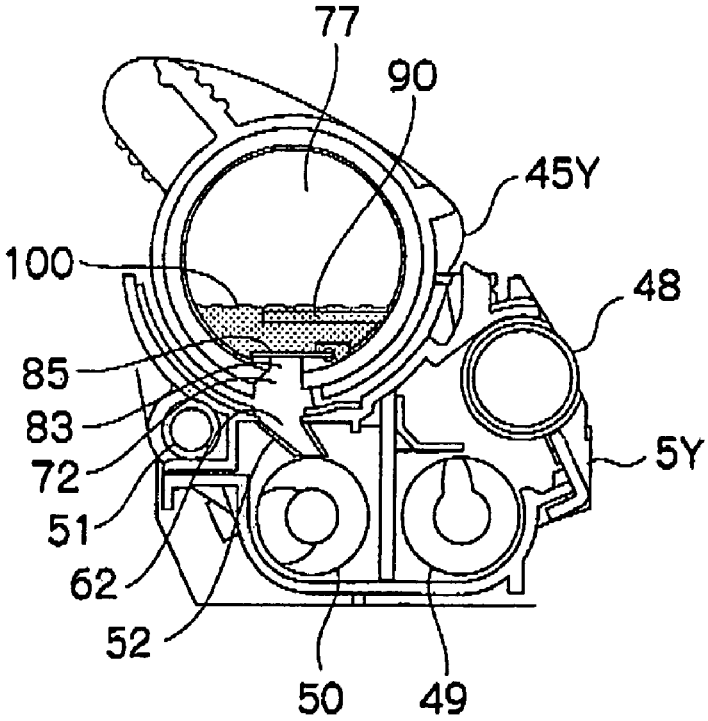

Therefore, as shown in FIG. 10B, due to gravity, the shutter 85 closes the opening portion 83 and the recovery opening 72 corresponding thereto (hereinafter, mention of the opening portion 83 will be omitted), and the used developer 100 within the developing unit 5Y is not recovered to the housing chamber 77. Further, because the shutter 85 closes the recovery opening 72, the used developer 100 within the housing chamber 77 does not flow back into the developing unit 5Y.

Figure 11A:
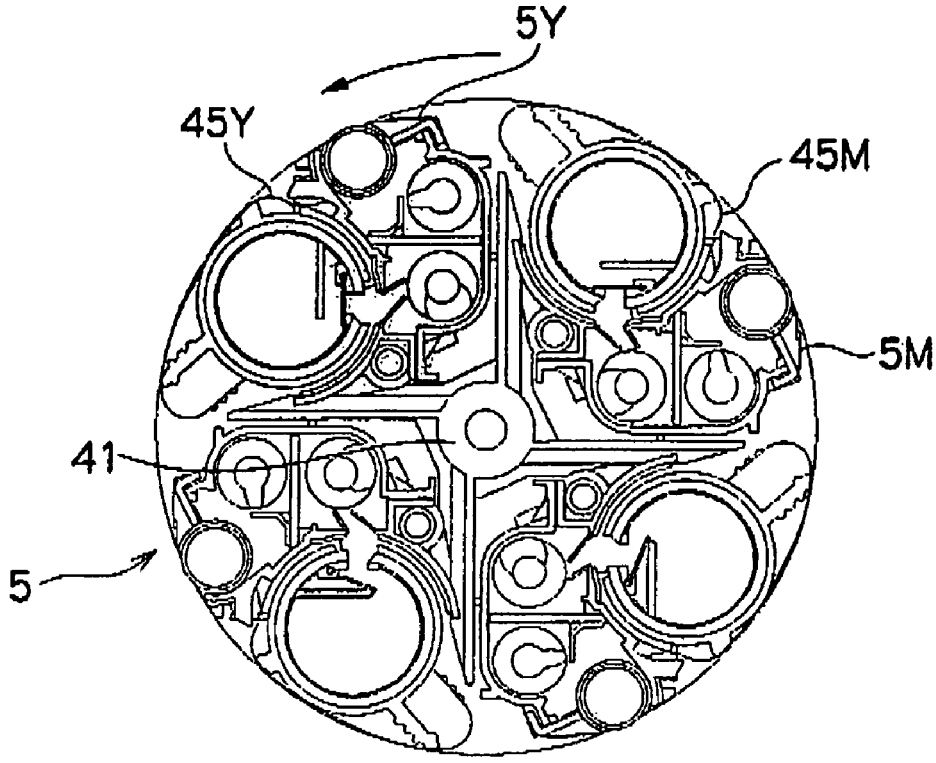
FIGS. 11A and 11B are drawings for explaining the developer recovering mechanism of the full-color printer relating to the first embodiment of the present invention.

Next, as shown in FIG. 11A, the rotating shaft member 41 rotates 90° in the direction of the arrow (counterclockwise), and developing by the magenta (M) developing unit 5M is carried out.

Figure 11B:
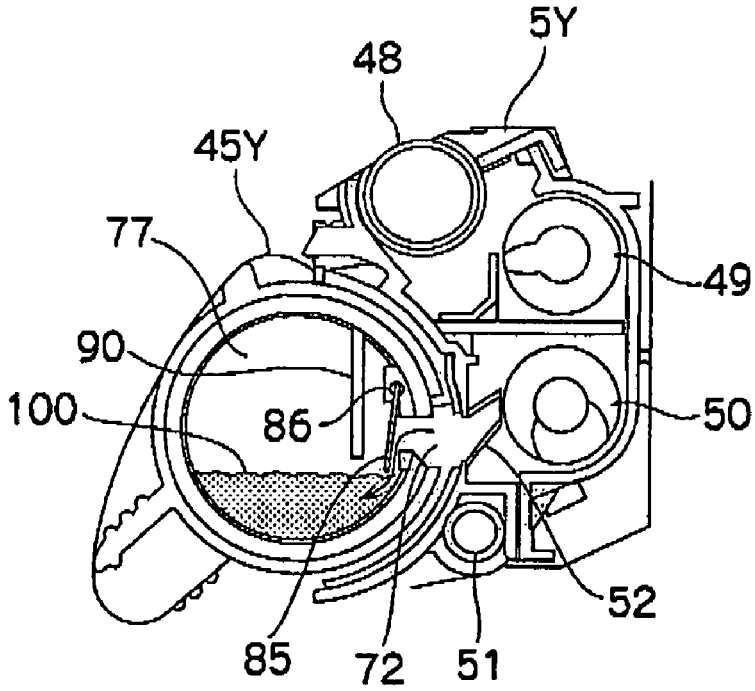

At this time, as shown in FIG. 11B, the developer cartridge 45Y is positioned at the lateral direction side of the developing unit 5Y, and the used developer 100 within the developing unit 5Y moves through the nozzle 52 toward the recovery opening 72. The shaft 86 is positioned above the shutter 85, and the shutter 85 is easily opened when pushed by the used developer 100 which has flowed-in to the nozzle 52. Therefore, the used developer 100 is recovered from the developing unit 5Y to the housing chamber 77.

Figure 12A:
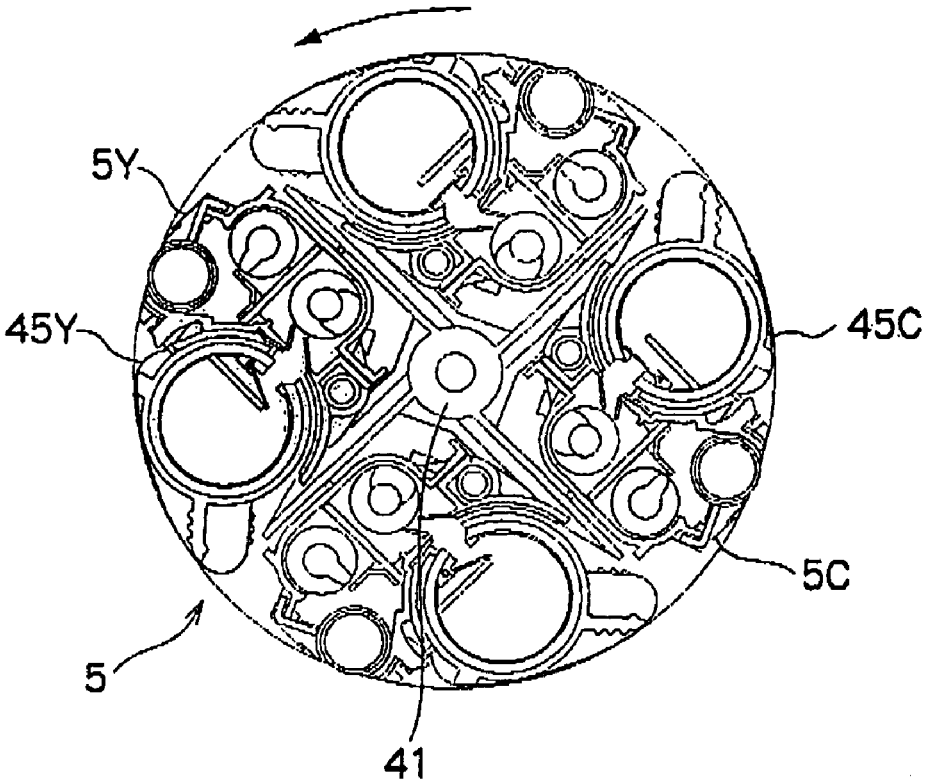
FIGS. 12A and 12B are drawings for explaining the developer recovering mechanism of the full-color printer relating to the first embodiment of the present invention.
Figure 12B:
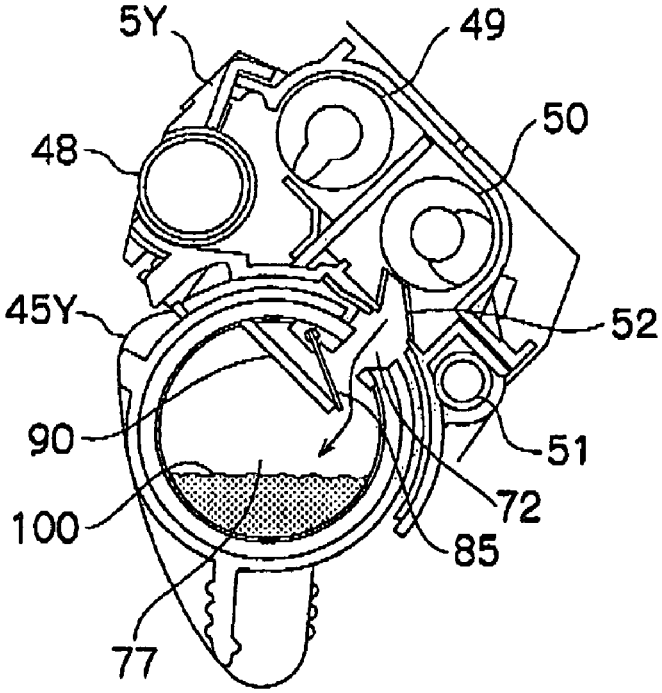
Figure 13A:
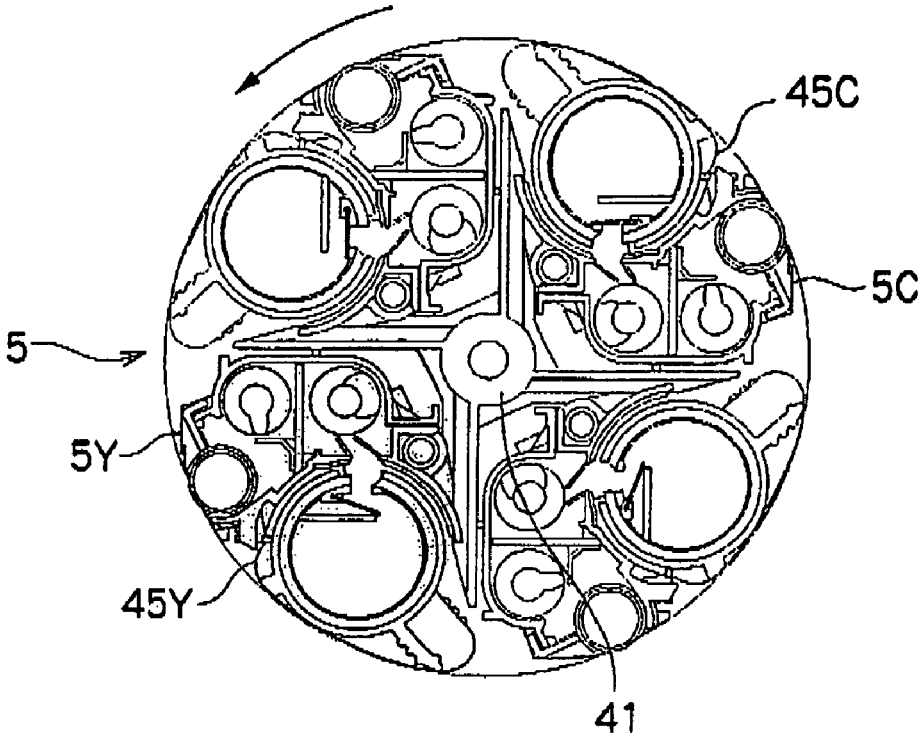
FIGS. 13A and 13B are drawings for explaining the developer recovering mechanism of the full-color printer relating to the first embodiment of the present invention.

Next, as shown in FIG. 13A, the rotating shaft member 41 rotates 90° in the direction of the arrow (counterclockwise), and developing by the cyan (C) developing unit 5C is carried out. In the midst of this rotation of the rotating shaft member 41, as shown in FIG. 12A, the developer cartridge 45Y is positioned diagonally beneath the developing unit 5Y. In this state, as shown in FIG. 12B, the shutter 85 is opened by the change in gravity and abuts the regulating plate 90. Then, the used developer 100 within the developing unit 5Y passes through the nozzle 52 and is recovered from the recovery opening 72 into the interior of the housing chamber 77.

Figure 13B:
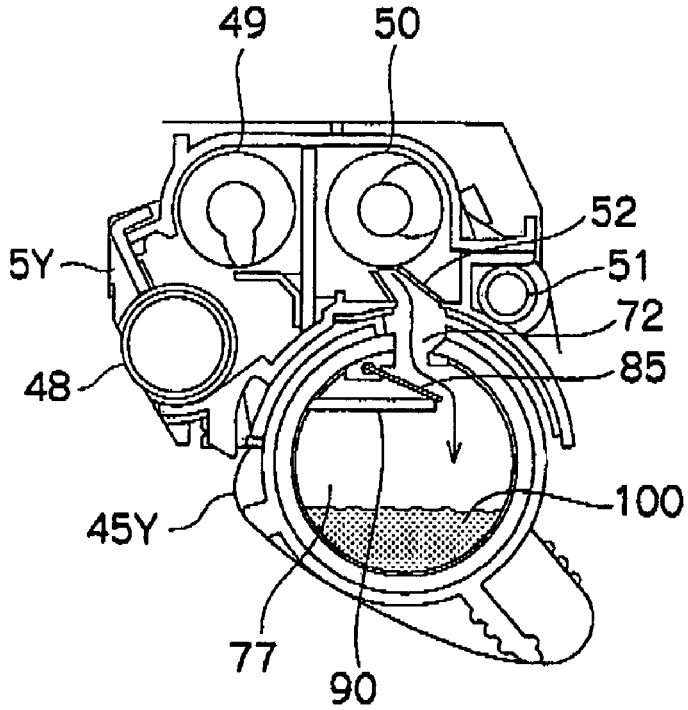

As shown in FIG. 13A, when developing by the cyan (C) developing unit 5C is carried out, the developer cartridge 45Y is positioned lower than the developing unit 5Y. In this state as well, as shown in FIG. 13B, the shutter 85 is open due to gravity, and the used developer 100 within the developing unit 5Y passes through the nozzle 52 and is recovered within the housing chamber 77 from the recovery opening 72.

Figure 14A:
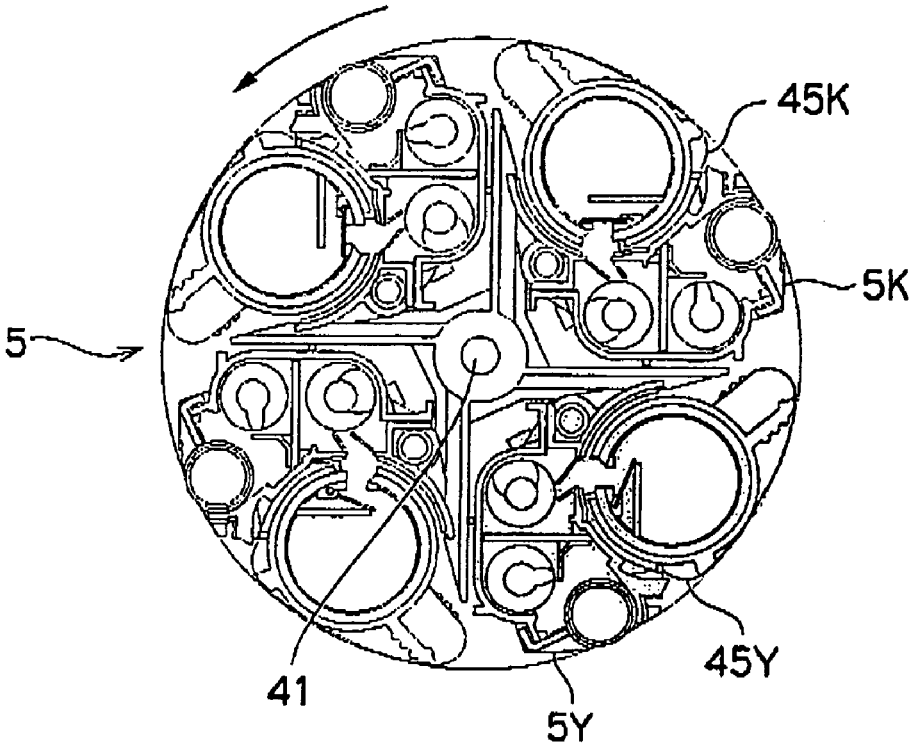
FIGS. 14A and 14B are drawings for explaining the developer recovering mechanism of the full-color printer relating to the first embodiment of the present invention.
Figure 14B:
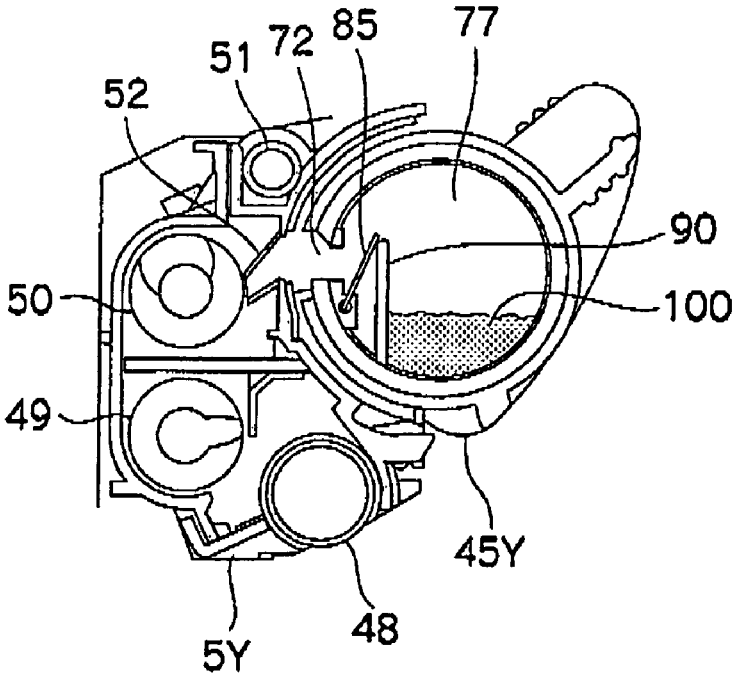

Next, as shown in FIG. 14A, the rotating shaft member 41 rotates 90° in the direction of the arrow (counterclockwise), and developing by the black (K) developing unit 5K is carried out. At this time, as shown in FIG. 14B, the developer cartridge 45Y is positioned at the lateral direction side of the developing unit 5Y, and the shutter 85 is open due to gravity and abuts the regulating plate 90. The upper portion of the regulating plate 90 is at a position which is higher than the top surface of the used developer 100 within the housing chamber 77. The used developer 100 is blocked by the regulating plate 90 and does not flow backward to the recovery opening 72. Therefore, the used developer 100 recovered in the developer cartridge 45Y is prevented from flowing backward to the developing unit 5Y.

Figure 15A:
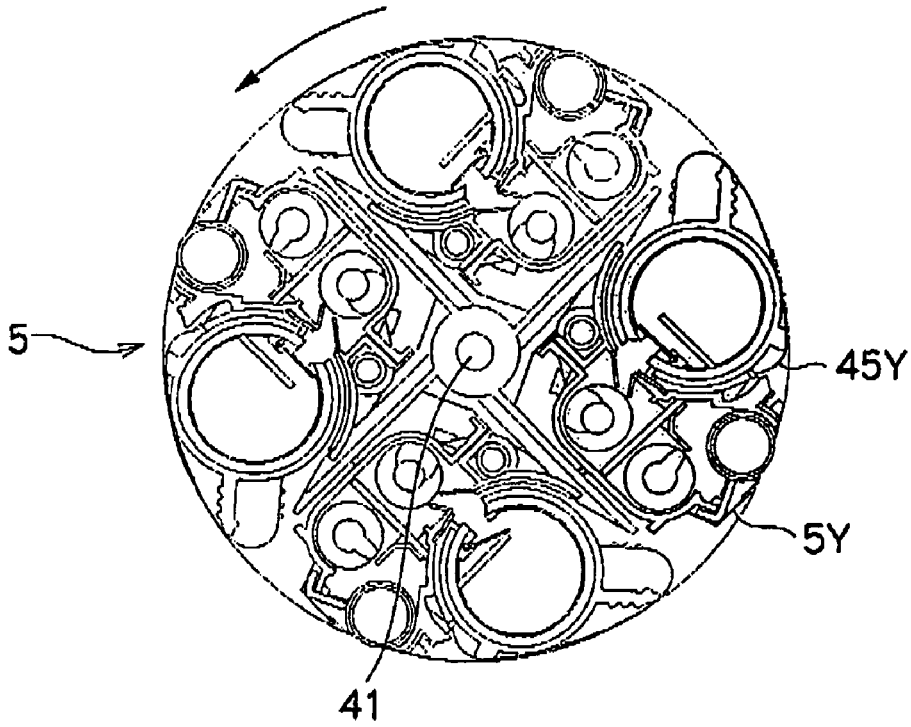
FIGS. 15A and 15B are drawings for explaining the developer recovering mechanism of the full-color printer relating to the first embodiment of the present invention.
Figure 15B:
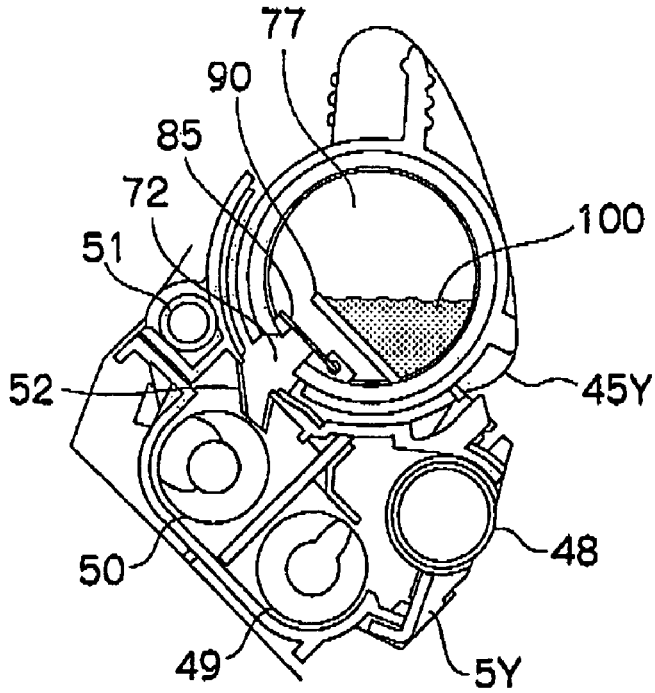

Then, the rotating shaft member 41 rotates 90° in the direction of the arrow (counterclockwise), and the developing unit 5Y moves to the developing region as shown in FIG. 10A. In the midst of this rotation of the rotating shaft member 41, as shown in FIG. 15A, the developer cartridge 45Y is positioned diagonally above the developing unit 5Y. In this state, as shown in FIG. 15B, the shutter 85 is closed by the change in gravity. Therefore, even if the used developer 100 within the housing chamber 77 crosses-over the regulating plate 90, it is prevented from flowing backward from the recovery opening 72 to the developing unit 5Y.

In the full-color printer 1 of the present embodiment, the shutter 85 is opened and closed by changes in gravity due to the rotation of the rotating shaft member 41. Therefore, due to the shutter 85 opening, the used developer 100 within the developing unit 5Y can be recovered in the developer cartridge 45Y.

Further, owing to the regulating plate 90, the used developer 100 of the developer cartridge 45Y can be reliably prevented from flowing backward to the developing unit 5Y.

Moreover, because the shutter 85 is plate-shaped and can reliably close the recovery opening 72, the used developer 100 can be reliably prevented from leaking to the developing unit 5Y.

In addition, the plate piece 82, which shaft-supports the shutter 85 of the opening portion 83, and the regulating plate 90 are molded integrally with the cap 80. Therefore, the assembly processes can be simplified, and the manufacturing cost can be reduced.

Note that the yellow (Y) developing unit 5Y was described as an example in the present embodiment, but the other developing units 5M, 5C, 5K, of course, also operate similarly.

What is claimed is:

1. A developer recovering mechanism used in a developing apparatus having a developer cartridge which houses developer, a developing unit in which the developer cartridge is installed and which can make a latent image of an image carrier visible by the developer, and a rotor at which the developing unit is loaded and which rotates and moves the developing unit successively to a developing region, the developer recovering mechanism comprising:

a housing chamber provided at the developer cartridge, for housing recovered developer;

a recovery opening for recovering developer, which is in the developing unit, into the housing chamber; and a shutter which is plate-shaped, one end side of the shutter being rotatably shaft-supported within the housing chamber, the shutter opening and closing the recovery opening in accordance with changes in gravity due to rotation of the rotor.

2. The developer recovering mechanism of claim 1, further comprising a regulating plate which stands erect from a shaft portion side of the shutter, and which regulates back flow of the developer within the housing chamber to the recovery opening.

3. The developer recovering mechanism of claim 2, wherein the regulating plate is provided so as to face the recovery opening, and regulates an angle of rotation of the shutter at a time when the shutter is open, the regulating plate being set to a height such that the developer within the housing chamber does not leak out to the recovery opening.

4. The developer recovering mechanism of claim 1, wherein the recovery opening and a shaft-supporting portion which supports a shaft portion of the shutter, are molded integrally with a tubular cap which is attached to an opening end of the housing chamber.

5. The developer recovering mechanism of claim 1, wherein the shutter is formed by a plate body which blocks the recovery opening, and a shaft which extends from a corner portion of the plate body, and the shaft-supporting portion, which is provided at the cap in order to support the shaft, is formed by a pair of groove portions which support end portions of the shaft, and a presser plate which is provided between the pair of groove portions and prevents the shaft from falling out from the groove portions.

6. The developer recovering mechanism of claim 2, further comprising a cap which is tubular and which is attached to an opening of the housing chamber and in which the recovery opening is formed, the regulating plate and the shutter being provided integrally with the cap.

7. An image forming apparatus comprising the developer recovering mechanism of claim 1.

8. A developer recovering mechanism used in a developing apparatus having a developer cartridge which houses developer, a developing unit in which the developer cartridge is installed and which can make a latent image of an image carrier visible by the developer, and a rotor at which the developing unit is loaded and which rotates and moves the developing unit successively to a developing region, the developer recovering mechanism comprising:

a housing chamber provided at the developer cartridge, for housing therein developer which is recovered from an interior of the developing unit such that the developer recovered from the interior of the developing unit does not mix with new developer;

a recovery opening formed in the housing chamber, for introducing the developer within the interior of the developing unit to the housing chamber therethrough;

a cap attached to an opening end of the housing chamber;

a solid plate-like shutter, one end side of the shutter being rotatably shaft-supported at the cap, the shutter being able to open and close the recovery opening in accordance with changes in gravity due to rotation of the rotor; and a regulating plate standing erect from the cap so as to face the recovery opening with the shutter being disposed between the regulating plate and the recovery opening.

9. The developer recovering mechanism of claim 8, wherein the shutter rotates in accordance with changes in gravity due to the rotation of the rotor and contacts the regulating plate accordingly, and rotation of the shutter is thereby regulated.

10. The developer recovering mechanism of claim 8, wherein the regulating plate is set to a height such that the developer within the housing chamber does not leak out to the recovery opening when the shutter is open.

11. The developer recovering mechanism of claim 8, wherein the regulating plate is disposed apart from the shutter so as to permit sufficient opening of the recovery opening when the shutter is open.

12. The developer recovering mechanism of claim 8, wherein the recovery opening, a shaft portion of the shutter, and the regulating plate are substantially parallel to one another.

13. The developer recovering mechanism of claim 8, wherein the shutter is formed by a plate body which blocks the recovery opening, and a shaft which extends from a corner portion of the plate body, and a shaft-supporting portion, which is provided at the cap in order to support the shaft, is formed by a pair of groove portions which support end portions of the shaft, and a presser plate which is provided between the pair of groove portions and prevents the shaft from falling out from the groove portions.

14. The developer recovering mechanism of claim 13, wherein the cap further has a plate piece in which an opening corresponding with the recovery opening is formed, and the shaft-supporting portion is provided integrally with the plate piece.

15. The developer recovering mechanism of claim 14, wherein the regulating plate stands erect substantially parallel to the plate piece.

16. An image forming apparatus comprising the developer recovering mechanism of claim 8.

* * * * *